United States Patent [19]

Tolnai et al.

[11] 4,188,676

[45] Feb. 19, 1980

[54] PUSH-PUSH DRAIN CLOSURE ASSEMBLY

[75] Inventors: Julius L. Tolnai, Los Angeles; Matthew G. Tarnay, Pasadena, both of Calif.

[73] Assignee: Price-Pfister Brass Mfg. Co., Pacoima, Calif.

[21] Appl. No.: 938,841

[22] Filed: Sep. 1, 1978

[51] Int. Cl.[2] ..... A47K 1/14

[52] U.S. Cl. ..... 4/295; 251/75

[58] Field of Search ..... 4/287, 295, 286, 204, 4/191, 194; 251/75, 323, 322, 321, 320; 215/216

[56] References Cited

U.S. PATENT DOCUMENTS

| | | | |
|---|---|---|---|
| 3,949,433 | 4/1976 | Liou | 251/75 |
| 3,995,333 | 12/1976 | Stephens | 4/286 |
| 4,006,498 | 2/1977 | Cuschera | 4/286 |
| 4,103,372 | 8/1978 | Cuschera | 4/287 |

*Primary Examiner*—Lenard A. Footland
*Attorney, Agent, or Firm*—Flam & Flam

[57] ABSTRACT

A drain closure includes a flexible seal member formed as a segment of a sphere and centrally mounted on a post located at the center of the drain. The seal member is bistable between opposite involuted positions. In one position its free edges snap downwardly to engage the flange of the drain nut and in the other position its free edges snap upwardly to open the drain. The post is guided for limited vertical movement in a centrally hubbed retainer so that downwrd movement of the post flips the seal member to its upwardly involuted position. A relatively rigid disk slidably mounted about a button attached to the top of the post shields the seal member from a hard stream of water issuing from the spout above, thereby preventing the closure member from accidentally snapping closed. Also, the disk shields the closure member from the current of waste water draining through the device, thereby preventing accidental closure. The disk furthermore serves as a means for transmitting a force, by finger or toe, for involuting the seal member so that it assumes a sealing relationship with the flange of the drain nut. The seal member has an integral biconical sleeve that surrounds the post to provide a spring return of the post to its normal position.

4 Claims, 4 Drawing Figures

PUSH-PUSH DRAIN CLOSURE ASSEMBLY

BACKGROUND OF THE INVENTION

1. Field of Invention

This invention relates to a drain closure assembly for a bathtub, lavatory or the like, and particularly to a drain closure assembly all operative parts of which are located at the drain body as contrasted with a drain closure assembly that includes extended linkages for remote control.

2. Discussion of the Prior Art

A drain closure assembly utilizing a bistable snap seal member is shown in U.S. Pat. No. 3,949,433 issued to Shu-Lien Liou. The central portion of the seal member is attached to a post slidable in the hub of a spider. The post itself is a complicated three part structure to accommodate a coil return spring. The edges of the seal member are exposed to the stream of water from the lavatory or tub spout which might cause the seal member to snap to a position opposite that intended. Also, a strong current of waste water may cause accidental closure.

U.S. Pat. No. 3,995,333 to Stephens shows a conventional seal member movable to engage the flange of the drain nut, but including a snap actuator member confined at its edges within a complicated assembly.

OBJECTIVES

The primary object of the present invention is to provide a drain closure assembly of the type shown and described in said Shu-Lien Liou patent, but in which the mounting of the seal member is vastly simplified, in which the seal member is effectively shielded by an actuator and whereby the assembly is in cartridge form for easy installation and removal.

SUMMARY OF INVENTION

The foregoing objects are accomplished by the provision of integral biconical sleeve spring depending from the central portion of the seal member to provide the requisite return force so that the post assembly is vastly simplified. A thin actuator disk is slidably mounted about a central button attached to the top of the seal member. It shields the seal member from the water stream issuing from the spout as well as from a current of waste water. It serves as a means to transmit digital or pedal pressure to the closure member when it is desired to close the drain. A touch on the central button snaps the seal member to open at which position the edges of the seal member engage within the peripheral edges of the disk.

DESCRIPTION OF THE DRAWINGS

A detailed description of the invention will be made with reference to the accompanying drawings wherein like numerals designate corresponding parts in the several figures. These drawings are to scale.

DESCRIPTION OF THE PREFERRED EMBODIMENT

Figure 1:
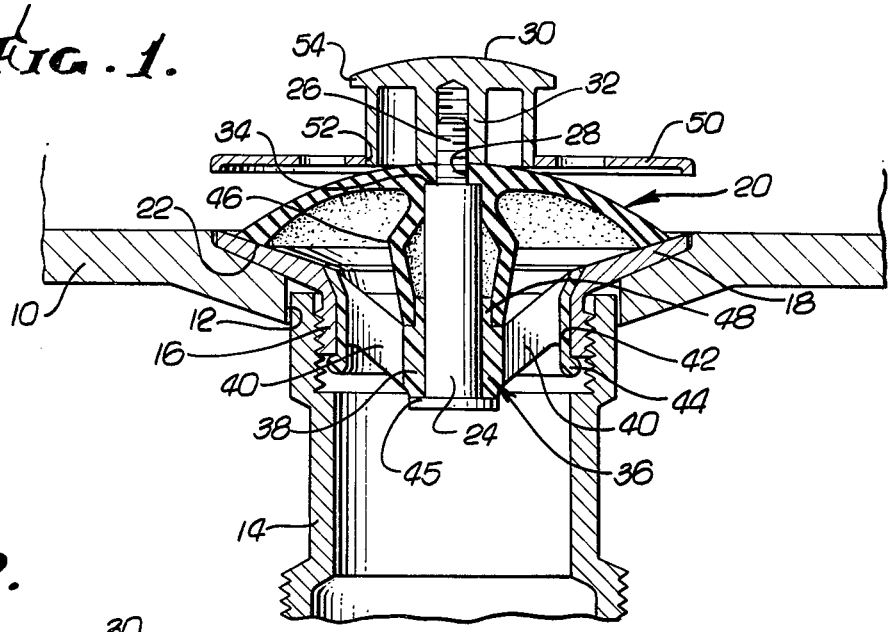
FIG. 1 is a vertical sectional view of a drain stopper assembly incorporating the present invention, the adjacent fragment of the drain body being shown in section.

The following detailed description is of the best presently contemplated mode of carrying out the invention. This description is not to be taken in a limiting sense, but is made merely for purposes of illustrating the general principles of the invention since the scope of the invention is best defined by the appended claims.

The lavatory 10 has a drain opening 12 that cooperates with a conventional lavatory drain body 14 to conduct waste water to the drainage system. In a bathtub installation, different fittings are provided. In any case, a socket is fitted in the drain opening. The socket comprises a flanged nut 16 having exterior threads that cooperate with the upper end of the drain body 14 whereby its flange 18 is clamped about the edges of the lavatory opening 12.

To close the drain, a flexible molded seal member or closure 20 is provided that cooperates with a seat surface provided by the nut flange 18. The closure is made of rubber or like material generally in the shape of a segment of a sphere. The curvature of the inside surface is greater than that of the outside surface. A thick peripheral rim 22 results that acts as a spring, resisting enlargement. The rim 22 has a flat surface that annularly contacts the upper surface of the nut flange 18.

The seal member 20 is mounted on the upper end of a stem 24. For this purpose, the stem has a reduced threaded extension 26 that extends through a central aperture 28 in the seal member 20. A button 30 has a threaded hub 32 that engages the end of the stem extension 26 to clamp the seal member against the shoulder 34 formed by the reduced extension 26.

The stem 24 is mounted on a retainer 36 fitted in the flanged nut 16. The retainer 36 may be made of molded plastic material. The retainer includes a central hub part 38 supported by vanes or ribs 40 extending inwardly from the generally tubular outer portion of the retainer 36. The opening 42 of the flanged nut 16, like the exterior of the retainer, tapers downwardly so that a nesting fit between the two is achieved. The entire assembly is in cartridge form for easy installation. For this purpose, a detent in the form of an annular bead 44 at the lower end of the retainer readily snaps beneath the lower edge of the nut opening 42 to lock the retainer in place. Upward movement of the stem or post 24 is limited by a flange 45 that abuts the lower end of the hub 38.

In order to open the drain, the central part of the seal member 20 is depressed by button 30. The closure 20 flattens against the nut flange 18, slightly expanding the resilient rim 22. As soon as the central part is depressed to an over center position, the spring action of the rim 22 causes the rim to snap upwardly to the position of FIG. 2. As soon as the stopper involutes, the button 30 is released and the stem returns to its upper limited position. The return movement is provided by a spring. The spring comprises a hollow biconical part 46 formed integrally with and depending from the central portion of the seal member 20. The spring 46 surrounds the stem 24 with its lower end fitted about a reduced upper extension 48 of the hub 38. When the button 30 is depressed, the central portion of the spring bulges outwardly, storing energy required to retract the post. Preferably the spring is slightly stressed when the stem is in its uppermost position.

Figure 2:
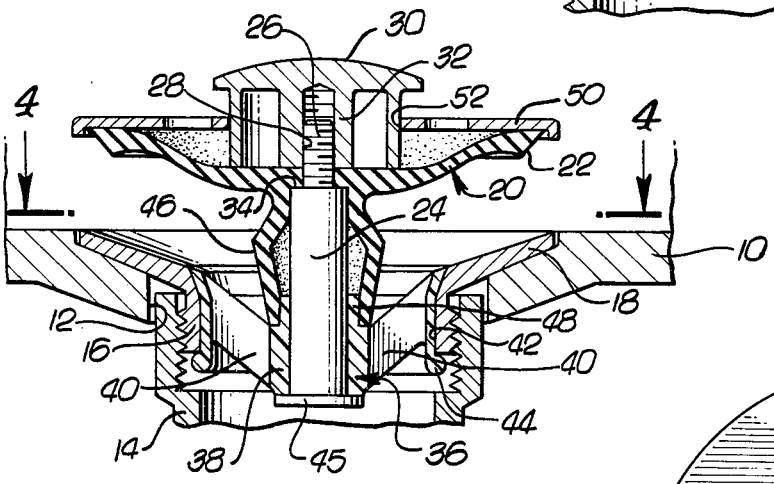
FIG. 2 is a sectional view similar to FIG. 1, but showing the assembly in open position.
Figure 3:
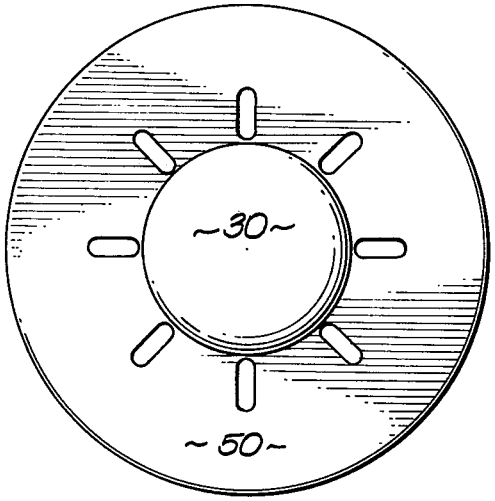
FIG. 3 is a top plan view of the drain stopper assembly.
Figure 4:
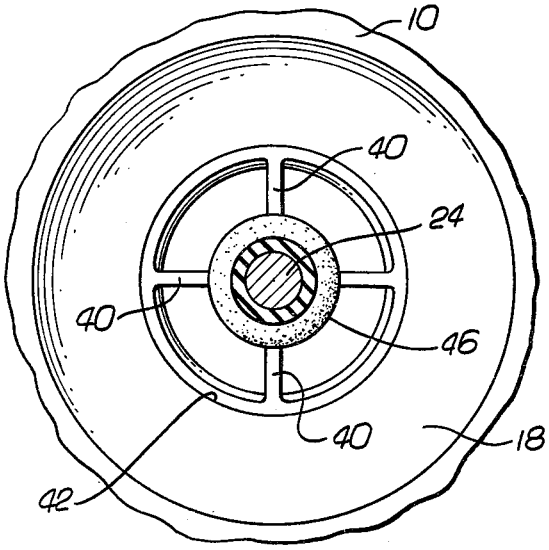
FIG. 4 is a sectional view taken along a plane corresponding to line 4—4 of FIG. 2.

In order to move the closure member 20 back from its upper involuted position, the peripheral rim 22 is pushed downwardly while the button 30 and central part of the closure member remain stationary. The rim 22 expands slightly until an over center position is reached, whereupon the seal member snaps closed under the spring action of the rim 22. To facilitate the transmission of force to the closure member, an actuator plate 50 is provided. The plate 50, in the form of a disk, has a central aperture 52 slidably surrounding the cylindrical peripheral surface of the button. A flange 54 on the button top confines the disk against separation. When the closure member has involuted upwardly, it carries the actuator 50 along as shown in FIG. 2.

The actuator disk 50 serves to shield the closure member 20 from the stream of water issuing from the spout which is often located almost directly above the drain. Accordingly, no spurious movement of the closure member is produced by the influent water. Also, when the closure is opened to drain waste water, the current of waste water is diverted from the top of the closure member whereby accidental closure is avoided.

The entire drain closure assembly is removed by pulling upwardly on the button 30 until the bead 44 snaps free of the flanged nut 16. When the cartridge is installed, reverse rotation of the button 30 carries the closure member 20 and the stem 24 along with it, thus ensuring against inadvertent separation of the closure member 20 from the stem.

Intending to claim all novel, useful and unobvious features shown or described, we make the following

We claim:

1. In a push-push drain closure assembly cooperable with an upwardly facing seat about the drain opening of a bathtub, lavatory or the like:

a. a socket fitted to the drain opening;

b. a stem substantially centrally mounted by the socket for limited vertical movement therein;

c. a seal member centrally mounted on the top of said stem and having a free peripheral sealing rim cooperable with said seat, said seal member normally having a pronounced curvature determining bistable normal and opposite involuted orientations of said rim relative to its central portion;

d. an actuator button attached to the center of said seal member for movement for depressing the seal member to snap it to its upwardly involuted position for opening the drain;

e. an actuator plate slidably accommodated on, and retained by, said actuator button, said actuator plate overlying said seal member and being operative to depress the peripheral portion of the seal member to snap it to its downwardly normal position for closing the drain;

f. spring means for returning the stem to its upward limited position; and g. said actuator plate shielding said seal member from the current of waste water and from the spout stream to prevent accidental movement of said seal member to its opposite position.

2. The combination as set forth in claim 1 in which said seal member is made of molded rubber-like material having a configuration substantially of a segment of a sphere and in which the seal member has an outer surface of lesser curvature than its inner surface, thereby providing a thickened spring-like rim for definitively snapping said seal member to its opposite positions.

3. The combination as set forth in claim 1 together with a peripheral bead integral with and located at the bottom of said socket to form a releasable snap connection of said socket to said drain opening.

4. In a push-push drain closure assembly cooperable with the drain opening of a bathtub, lavatory or the like:

a. a hollow nut cooperable with a drain body and having a flange to be clamped about the opening of a bathtub or the like, said nut having a lower edge accessible at the inside of the nut;

b. a hollow retainer nested in the nut and having a central hub portion, said retainer having a peripheral bead snap fitted to said lower edge of said nut;

c. a stem slidably mounted in said hub, said stem having stop means limiting upward movement thereof;

d. a seal member made of molded rubber-like material and having a configuration substantially as a segment of a sphere, said seal member being centrally mounted to the upper end of said stem and having a free peripheral sealing rim cooperable with said flange to close said drain, said seal member being movable to a stable upward involuted position to open said drain;

e. an actuator button attached to the center of said seal member and thereby to said stem for depressing said seal member to snap it to its upwardly involuted position to open said drain;

f. an actuator disk slidably mounted on said button and overlying said seal member, said disk being operative to depress the peripheral portion of said seal member to snap it to its downward normal stable position for closing the drain;

g. said seal member having an integral spring part surrounding said stem and extending downwardly from the central portion of said seal member, the distal end of said spring part being attached to said hub; and h. said disk shielding said seal member from the current of waste water and from the spout stream to prevent accidental movement of said seal member from its involuted position.

* * * * *